US009732528B1

(12) United States Patent
Kuo et al.

(10) Patent No.: US 9,732,528 B1
(45) Date of Patent: Aug. 15, 2017

(54) ACCESSIBLE PASSAGEWAY ASSEMBLY

(71) Applicants: Chingyao Kuo, Luzhou (TW); Norman William Liefke, Surrey (CA)

(72) Inventors: Chingyao Kuo, Luzhou (TW); Norman William Liefke, Surrey (CA)

( * ) Notice: Subject to any disclaimer, the term of this patent is extended or adjusted under 35 U.S.C. 154(b) by 0 days.

(21) Appl. No.: 15/361,525

(22) Filed: Nov. 28, 2016

(51) Int. Cl.

| | |
|---|---|
| ***E04F 11/00*** | (2006.01) |
| ***E04H 17/16*** | (2006.01) |
| ***E04H 17/22*** | (2006.01) |
| ***E04H 17/14*** | (2006.01) |

(52) U.S. Cl.
CPC ..... *E04F 11/002* (2013.01); *E04H 17/1421* (2013.01); *E04H 17/166* (2013.01); *E04H 17/22* (2013.01); *E04F 2011/005* (2013.01); *E04F 2011/007* (2013.01)

(58) Field of Classification Search
CPC ..... E04F 11/002; E04F 2011/005; E04F 2011/007; E04H 17/166; E04H 17/22; E04H 17/1421; E04H 17/002
USPC ..... 14/69.5–72.5
See application file for complete search history.

(56) References Cited

U.S. PATENT DOCUMENTS 3,976,209 A * 8/1976 Burton ..... B60P 1/435 14/69.5
5,862,884 A * 1/1999 Smith ..... B64F 1/315 14/69.5
6,526,614 B2 * 3/2003 Anderson ..... E01C 9/083 14/69.5
7,010,825 B1 * 3/2006 Finch Salas ..... A61G 3/061 14/69.5
7,240,388 B2 * 7/2007 Warford ..... A61G 3/061 14/69.5
7,607,186 B1 * 10/2009 Mitchell ..... E04F 11/002 14/69.5
7,793,374 B1 * 9/2010 Anderson ..... B63B 21/00 114/362
7,939,759 B2 * 5/2011 Henry ..... H02G 3/0406 174/101
8,001,643 B1 * 8/2011 James ..... F16L 3/23 14/69.5
8,342,211 B2 * 1/2013 King ..... F16L 3/04 104/275
8,370,982 B2 * 2/2013 Peters ..... E04F 11/002 14/69.5
8,387,191 B2 * 3/2013 Honeycutt ..... B63B 27/14 114/362

(Continued)

*Primary Examiner* — Raymond W Addie
(74) *Attorney, Agent, or Firm* — Bacon & Thomas, PLLC

(57) ABSTRACT

An accessible passageway assembly is assembled by a plurality of railing units, a plurality of columns, a plurality of step plates and slope guide plates; specifically, the plurality of railing units are spaced by columns to form inner fences and outer fences of the passageway. A support bar is positioned between the lower end of columns of the inner fences and the lower end of columns of the outer fences. A platen is disposed above the support bar. The rear and front end of the support bar and the platen include an extending tongue piece respectively for fast snap-fit of the step plate and the slope guide plate of the passageway. The connection part of the railing unit and the column can be a movable hinge, such that the angle of the railing unit can be adjusted according to the passageway height difference and change, such that the accessible passageway can be quickly assembled and disassembled indoors or outdoors.

8 Claims, 10 Drawing Sheets

(56) References Cited

U.S. PATENT DOCUMENTS

| | | | | |
|---|---|---|---|---|
| 8,806,690 | B1 * | 8/2014 | Keith | B64F 1/3055 114/362 |
| 8,869,331 | B2 * | 10/2014 | Pegot-Ogier | B65F 1/0033 108/25 |
| 8,869,334 | B1 * | 10/2014 | Leum | B65G 69/30 14/69.5 |
| 8,959,693 | B2 * | 2/2015 | Pohlman | E01D 1/00 14/69.5 |
| 2006/0059636 | A1 * | 3/2006 | Suggate | E04F 11/002 14/69.5 |
| 2009/0255066 | A1 * | 10/2009 | Brock | A63C 19/10 14/69.5 |
| 2012/0036653 | A1 * | 2/2012 | Peters | E04F 11/002 14/69.5 |
| 2013/0047352 | A1 * | 2/2013 | Corfield | B64F 1/315 14/69.5 |
| 2013/0055511 | A1 * | 3/2013 | McGivern | E04F 11/002 14/69.5 |

* cited by examiner

ACCESSIBLE PASSAGEWAY ASSEMBLY

BACKGROUND OF THE INVENTION

1. Field of the Invention

The present invention relates to an accessible passageway, particular to an accessible passageway assembly which can be quickly constructed through assembly of a plurality of components in a snap-fit way and quickly assembled/disassembled. Furthermore, the gradient of the passageway can be adjusted according to the on-site environment.

2. Description of the Related Art

With the civilization and economic development, the government and the society began to pay more attention to people with mobility problems due to aging, diseases or accidents. In addition to the establishment of a sound medical system, people with mobility problems need to be provided with ancillary facilities to facilitate their mobility. For example, in public places, more accessible passageways have been provided to enable people with mobility problems to move and enter/exit buildings through wheelchairs or slow motion.

Conventional accessible passageways are mostly fixed passageways, which are mainly laid and paved with cement and stone. Both sides of a passageway are disposed with fences which are mostly made of stainless steel welding. The lower ends of the fences are fixed by cement.

However, the fixed passageways are almost unable to be changed after the laying is completed, without use of flexibility, unable to be adjusted according to the location changes or according to different age and injury conditions. Usually, in the outdoor exhibition hall or a large gathering place, a temporary passageway can be constructed through assembly of plates, but the temporarily constructed passageway, often because of simple structure and lack of stability, is prone to danger, unless there are people in the side to assist.

In view of the aforementioned shortcomings with regards to the wearable device, after a long period of research in conjunction with improvement on the aforementioned deficiency, the present invention is eventually presented by the inventor.

SUMMARY OF THE INVENTION

Accordingly, it is a major objective of the present invention to provide an accessible passageway assembly which is constructed through assembly of a plurality of components in a snap-fit way and is suitable for indoor or outdoor use in different occasions.

It is a secondary objective of the present invention to provide an accessible passageway assembly whose appearance can be designed to achieve fast and stable engagement of components that constitute the accessible passageway assembly such as railing units, columns, step plates, and slope guide plates to achieve a safe assembly structure.

It is another objective of the present invention to provide an accessible passageway assembly in which the connection part of the railing unit and the column is a movable pivot, so that the gradient of the entire passageway can be adjusted at any time depending on the person using it or the laying place.

It is a further objective of the present invention to provide an accessible passageway assembly which can be assembled in a U-shape) (180°), L-shape (90°), linear or other shapes according to the on-site environmental requirements since each component is assembled by snap-fitting. The gradient of the step plate can be adjusted in the range of 5° to 13°.

It is a further objective of the present invention to provide an accessible passageway assembly, through arrangement of a plurality of thin railings between the railing units, people with mobility difficulties, even in unaccompanied, can move freely through the support of the thin railings.

The detailed structure, application principles, functions and effectiveness of the present invention will be apparent with reference to the following description in conjunction with the accompanying drawings.

BRIEF DESCRIPTION OF THE DRAWINGS

FIG. 2 is an enlarged view of Part A in. FIG. 1;

FIG. 6 is an enlarged view of Part B in. FIG. 1;

DETAILED DESCRIPTION OF THE PREFERRED EMBODIMENT

Figure 1:
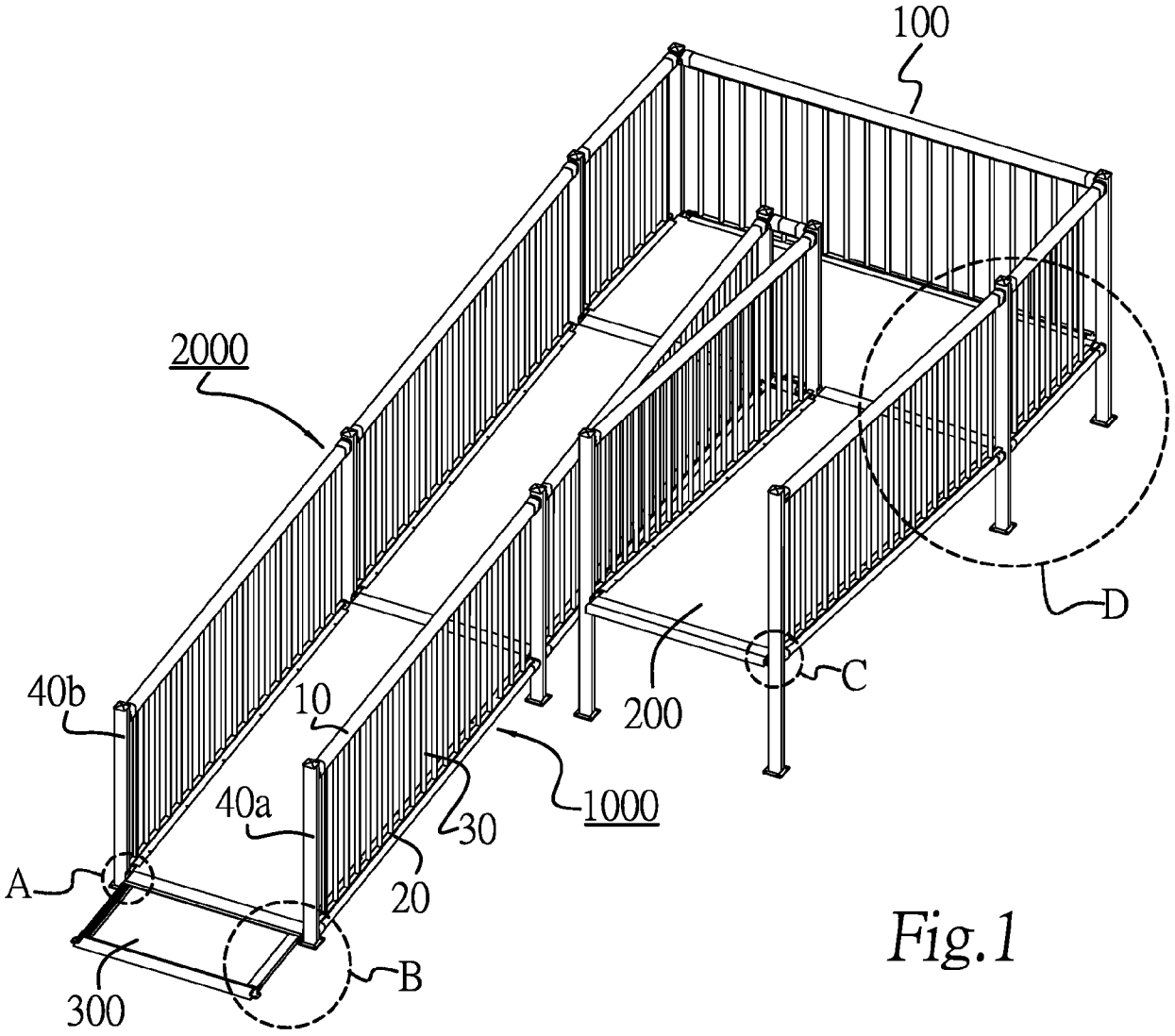
FIG. 1 is an assembly perspective view of an accessible passageway assembly in the present invention.

Please refer to FIG. 1. As shown, an accessible passageway assembly in the present invention is assembled by a plurality of railing units 100, a plurality of step plates 200 and a slope guide plate 300. Specifically, the railing unit 100 is assembled by an upper railing support bar 10, a lower railing support bar 20, and a plurality of thin railings 30 which are provided with interval between the upper railing support bar 10 and the lower railing support bar 20. Parts of the railing units 100 are connected at interval through an inner column 40*a* to form an inner fence 1000 of the passageway, and parts of the railing units 100 are connected at interval through an outer column 40*b* to form an outer fence 2000 of the passageway.

Figure 3:
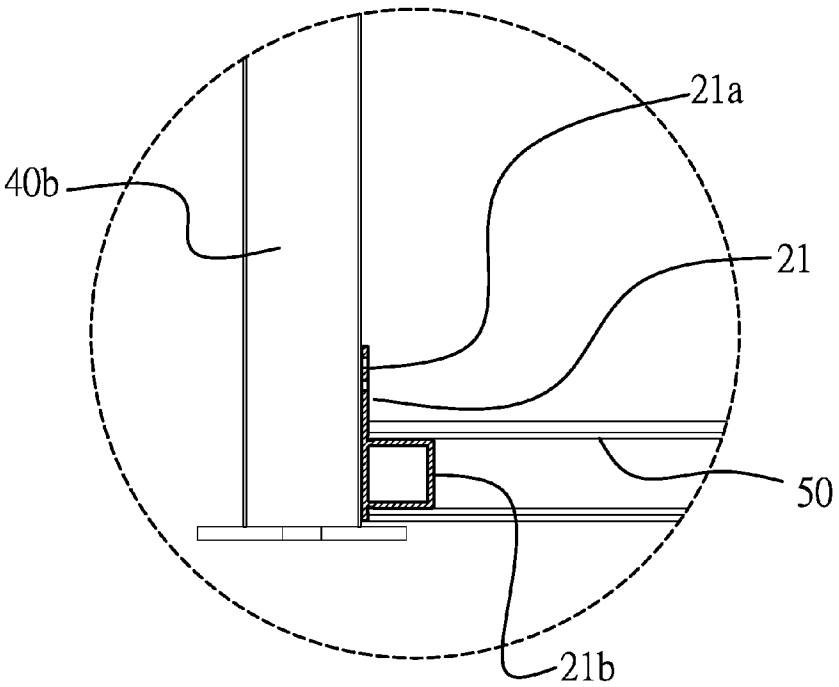
FIG. 3 is a cross-sectional view of Part A in FIG. 1.
Figure 2:
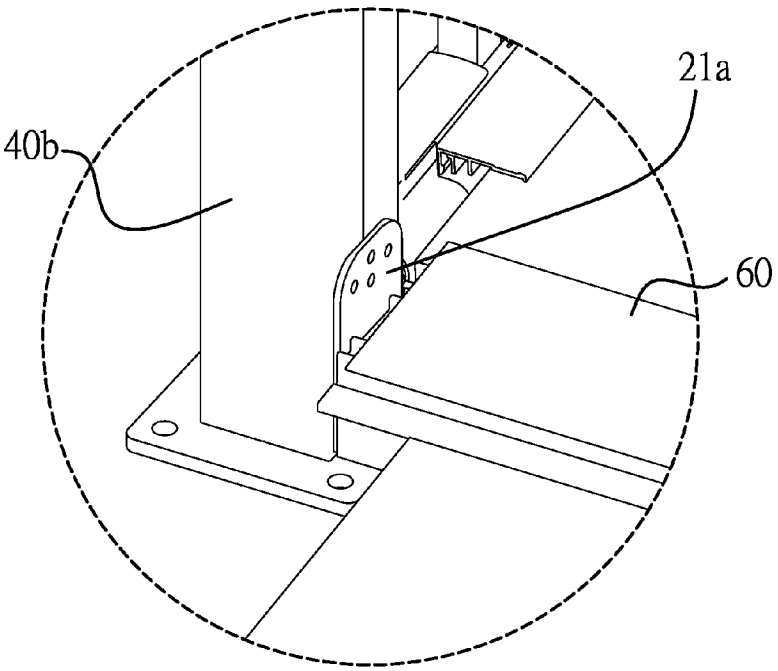

Please refer to FIGS. 2 and 3. As shown, each said inner column 40*a* is connected to a support bar 50 disposed between each of the outer columns 40*b*. As shown, the support bar 50 is connected to the inner column 40*a* or the outer column 40*b* through a connecting element 21. The connecting element 21. is provided with a vertical plate 21*a* that is locked and fixed onto the inner column 40*a* or outer column 40*b* through a screw. A bump 21*b* is disposed at the lower end of vertical plate 21*a* such that the bump 21*b* can be embedded into both sides of the support bar 50, and the support bar 50 can be fixed between the inner column 40*a* and the outer column 40*b*.

Figure 4:
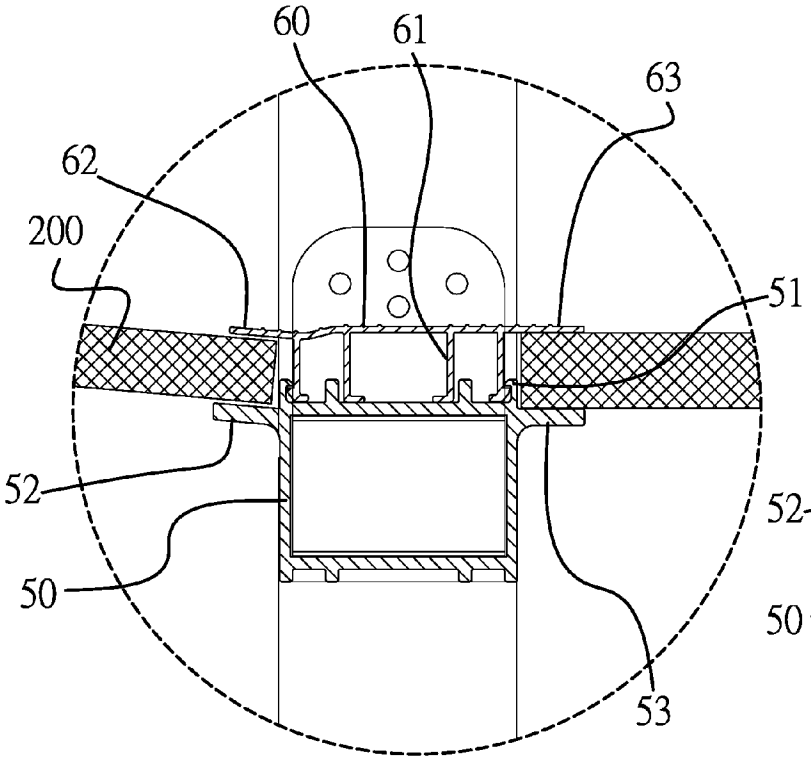
FIG. 4 is a cross-sectional view showing a support bar and a platen assembled to a column according to the present invention.

Please also refer to FIG. 4. As shown, the upper end of the support bar 50 is formed with a plurality of convex hooks 51, and the front and rear side thereof are provided with a protruding lip plate 52, 53, respectively. The lower end of a platen 60 is provided with a hook 61 for engagement with the convex hook 51 of the support bar 50. The front and rear sides thereof are provided with a pressing lip 62, 63, respectively; thus, when the platen 60 is joined to the upper end of the support bar 50 by the hook 61, its protruding pressing lips 62, 63 and the lip plates 52, 53 of the support bar 50 may form an accommodation space, so that the step plate 200 can be inserted sideways into the accommodating space, whereby the step plate 200 is supported and fixed by the support bar 50 at both the front and rear ends.

Figure 5:
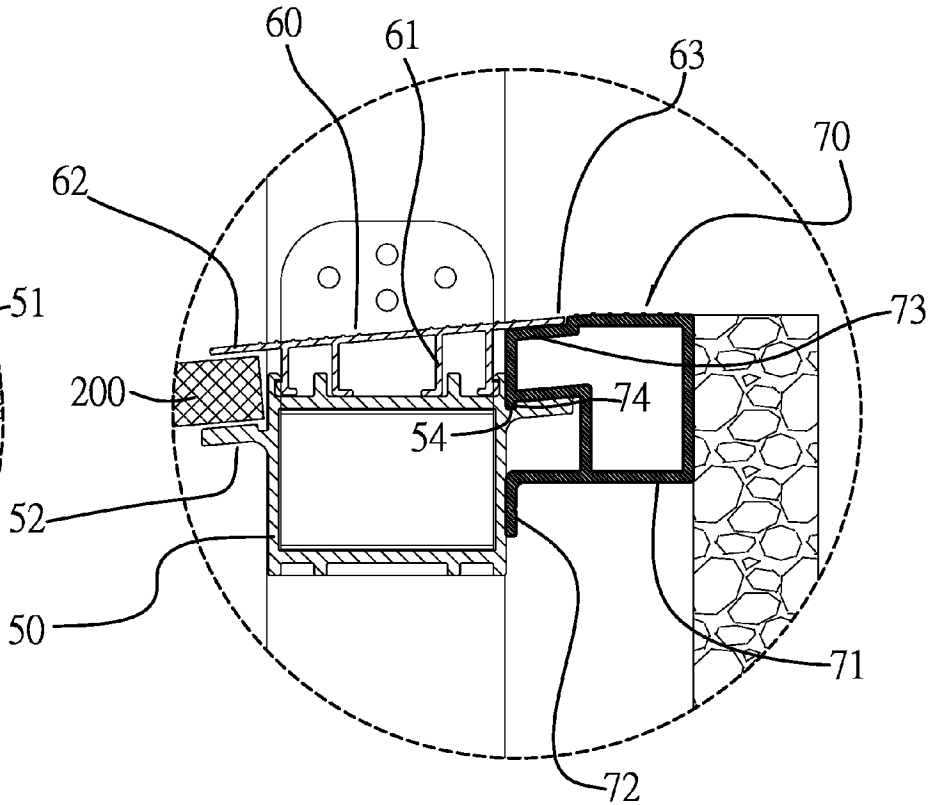
FIG. 5 is a cross-sectional view showing a support bar and a platen assembled to a column according to a second embodiment of the present invention.

The gradient between the lip plates 52, 53 of the support bar 50 and the pressing lips 62, 63 of the platen 60 may vary depending on the mount position of the support bar 50 and the platen 60. As shown in FIG. 5, when the support bar 50 and the platen 60 are located close to the steps of the building, the lip plate 52*a* at one end thereof and the pressing lip 62*a* can be tilted downwards for insertion of the step plate 200, the lip plate 53*a* and the pressing lip 63*a* at the opposite end can be tilted upwards. Also, a retaining groove 54 is formed on the lip plate 53*a* for a wall-against fastener 70 to be embedded therein.

As shown, the wall-against fastener 70 is an aluminum extruded frame, which includes a frame body 71. One side of the frame body 71 is coupled to an inverted L-shaped member 72 to be against one side of the support bar 50. A buckle portion 73 is formed at an end of the frame body 71. A bump 74 is formed at a tail end of the buckle portion 73 for insertion of a retaining groove 54 of the support bar 50. Thus, the wall-against fastener 70 can be quickly snapped into the support bar 50 and the platen 60. Also, the frame body 71 can be against the building steps such that wheelchairs can access the building easily.

Figure 6:
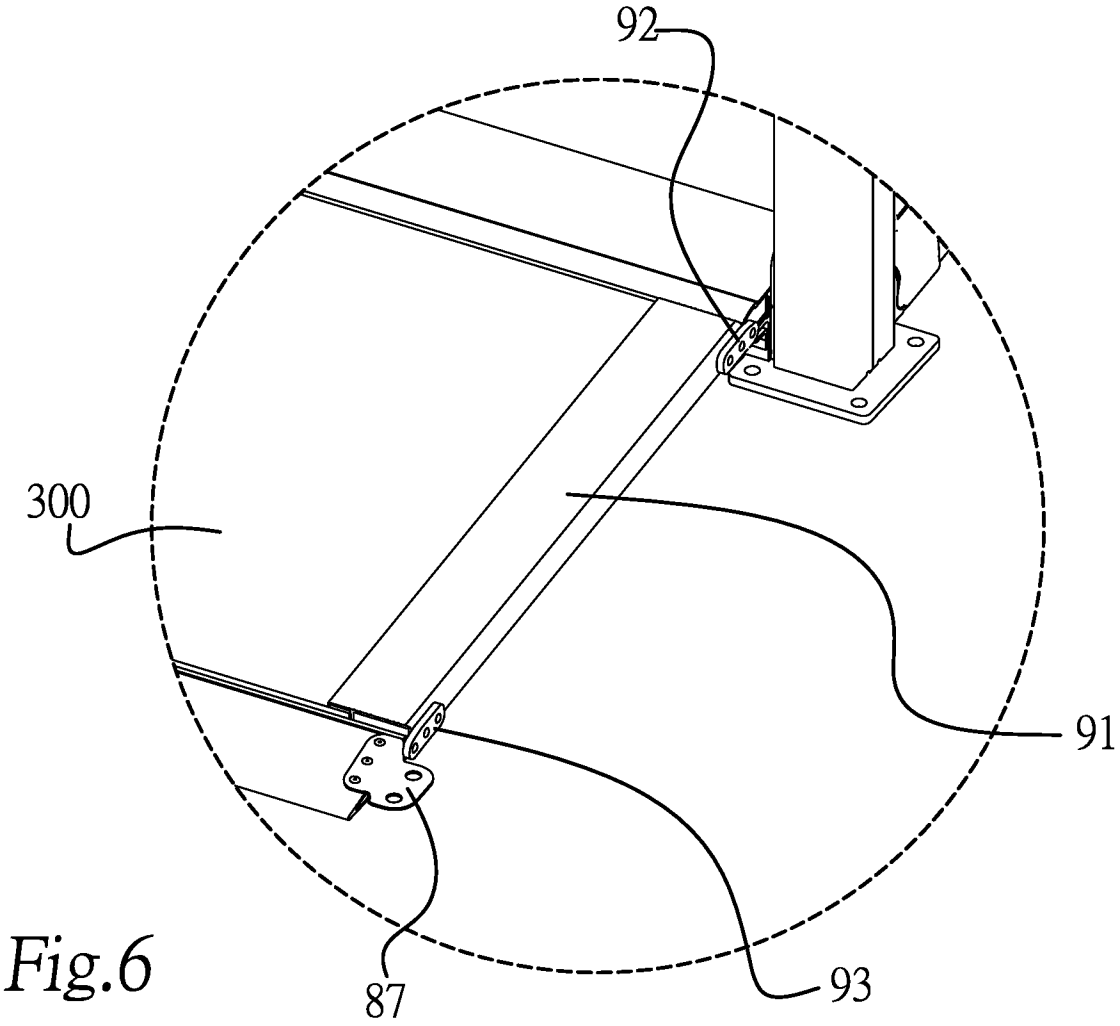
Figure 7:
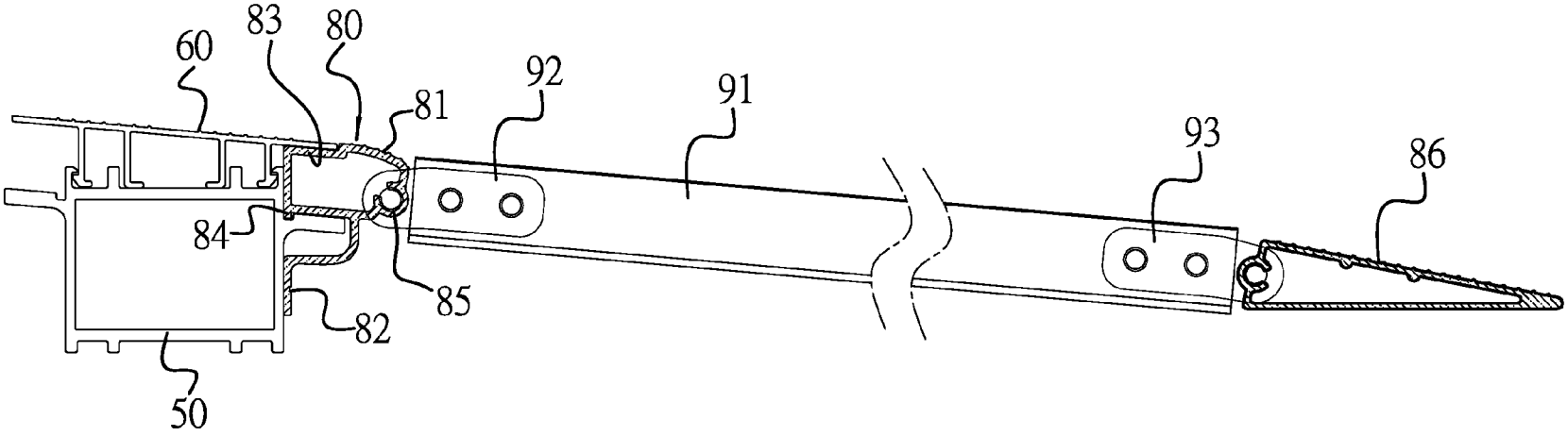
FIG. 7 is a cross-sectional view showing the assembly of a support bar, a platen and a guide support bar in the present invention.

Please refer to FIGS. 6 and 7. When the support bar 50 and the platen 60 are arranged at the forefront of the passageway, a lip plate 53*b* at one end and a pressing lip 63*b* can be tilted downwards. A retaining groove 54*b* is formed on the lip plate 53*b* for an oblique lead plate fastener 80 to be embedded therein.

As shown, the lead plate fastener 80 is provided with a frame body 81. One side of the frame body 81 is attached to an inverted L-shaped member 82 to be against one side of the support bar 50. A buckle portion 83 is formed at an end of the frame body 81, and a bump 84 is formed at an end of the buckle portion 83 to be embedded into a retaining groove 54*b* of the support bar 50. Thus, the lead plate fastener 80 can snap into the support bar 50 and the platen 60 quickly. In addition, a coupling hole 85 is formed in the interior of the frame body 81. The coupling hole 85 allows a guide support bar 91 to be assembled and fixed by a first thumb lock 92. An end of the guide support bar 91 gets obliquely contact with the ground. An end of the guide support bar 91 can be used for engagement with a guide plate member 86 with an end in a pointed shape through a second thumb lock 93, such that a wheelchair can enter the passageway through a slope guide plate 300 provided between the two guide supports bars (as shown in FIG. 1). Also, the guide plate member 86 can be fixed through a ground fixture 87.

Figure 8:
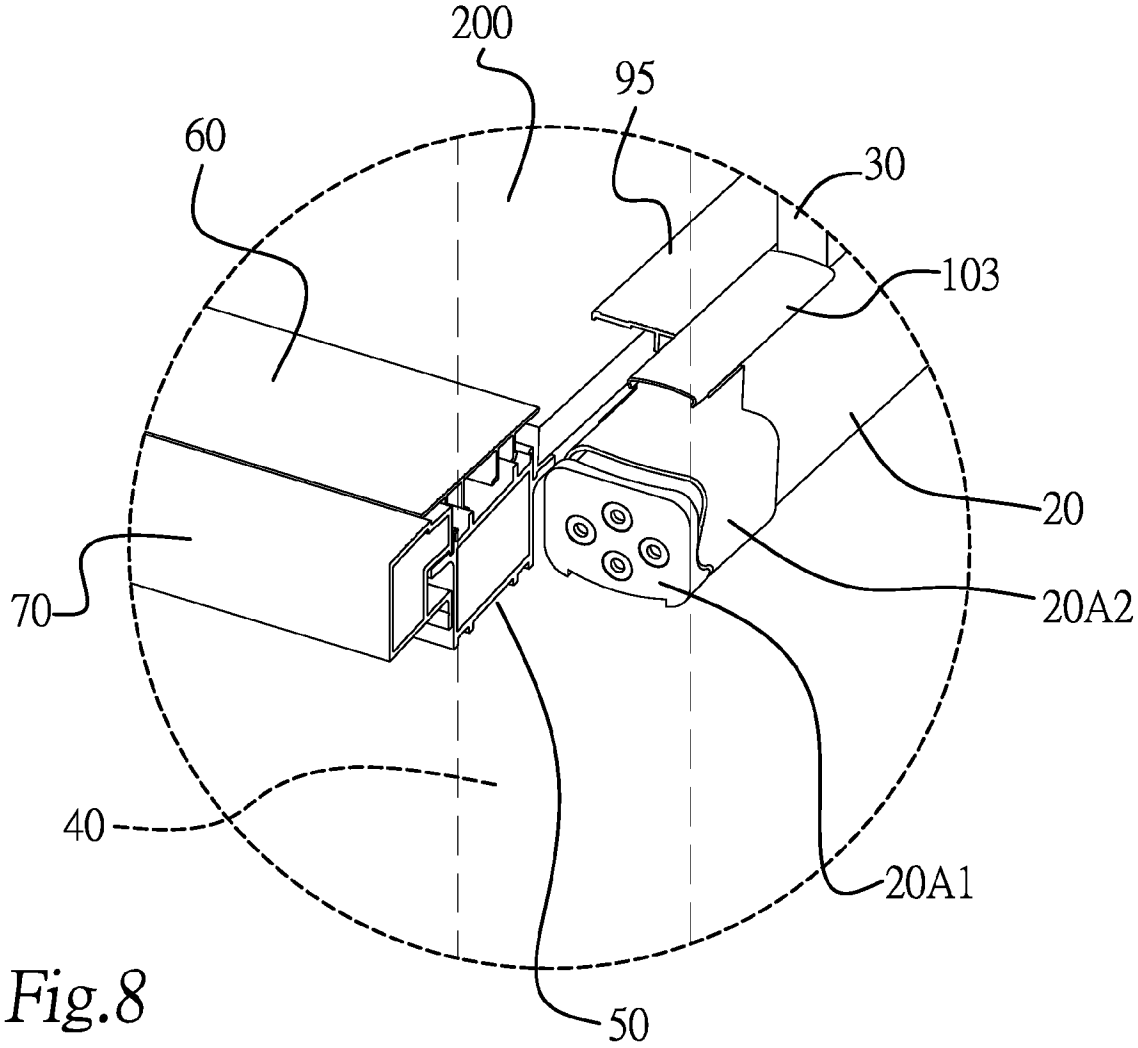
FIG. 8 is an enlarged perspective view of Part C in FIG. 1.
Figure 9:
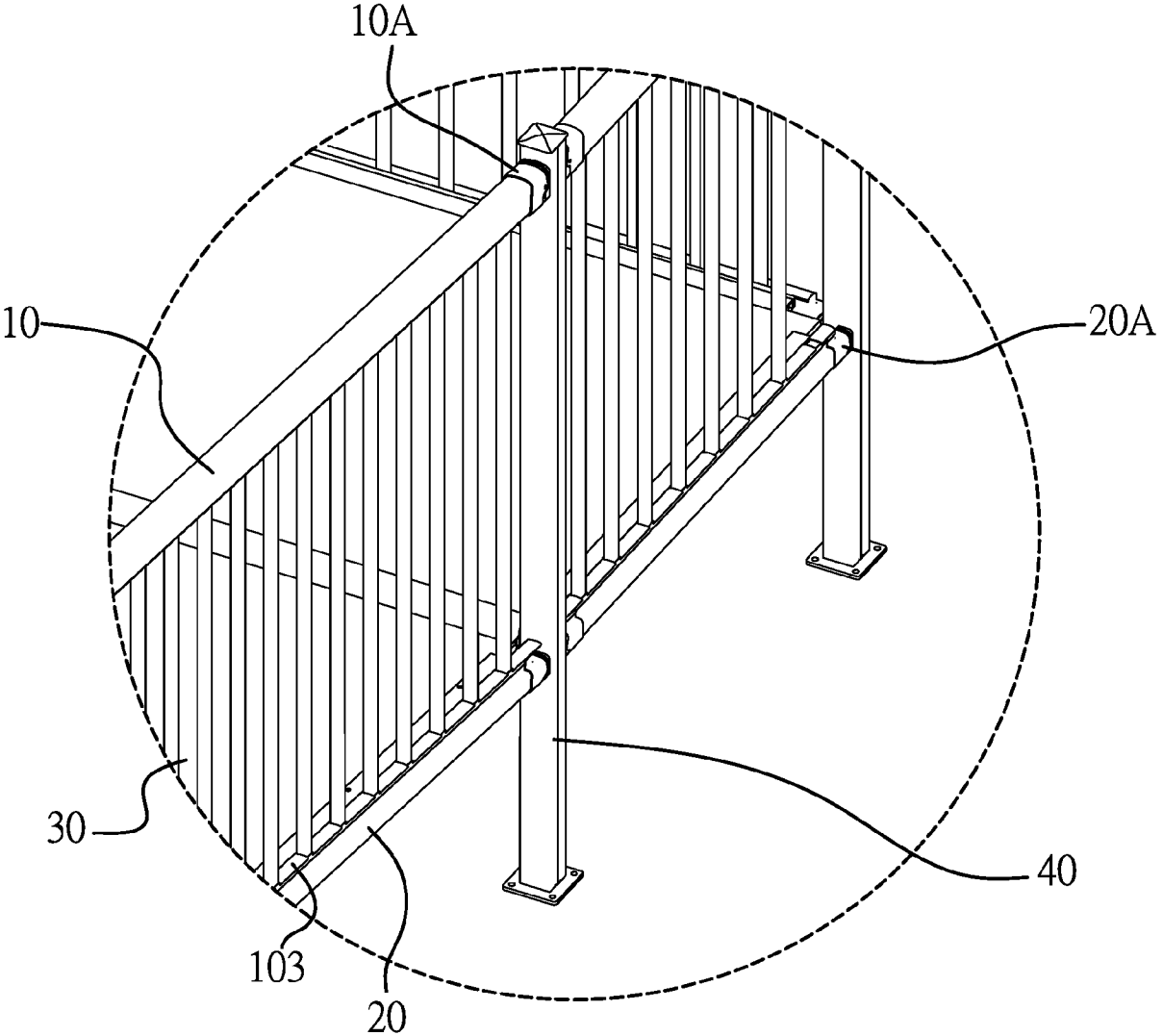
FIG. 9 is an enlarged view of Part D in FIG. 1.
Figure 10B:
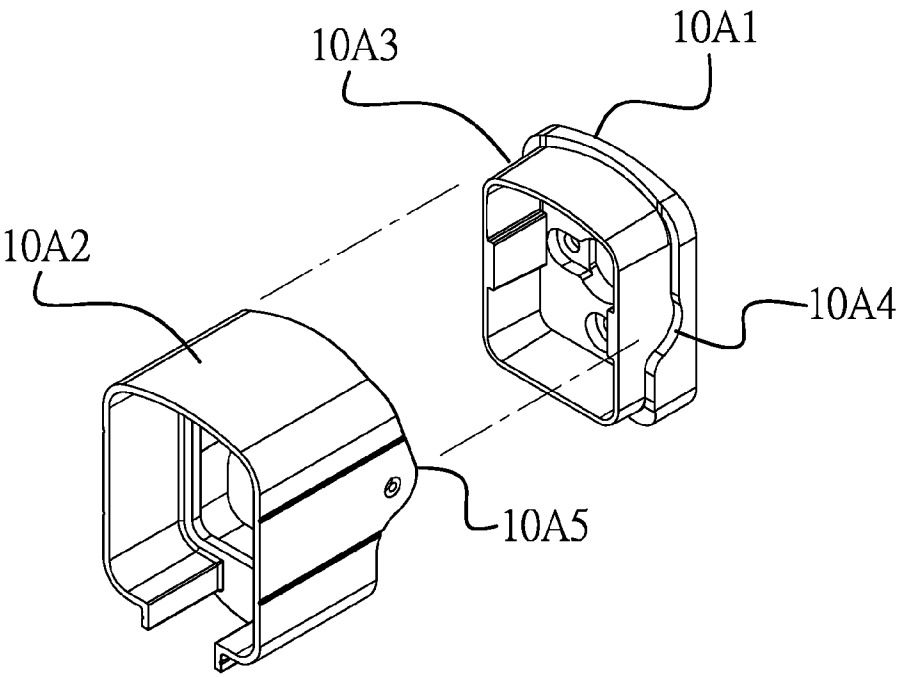
FIG. 10B is an exploded perspective view of an upper pivot element in the present invention.
Figure 10A:
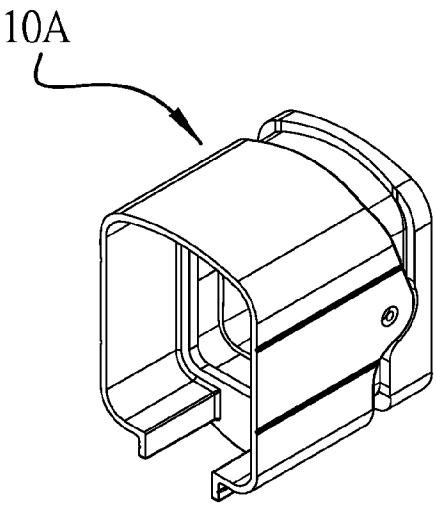
FIG. 10A is an assembly perspective view of an upper pivot element in the present invention.
Figure 11B:
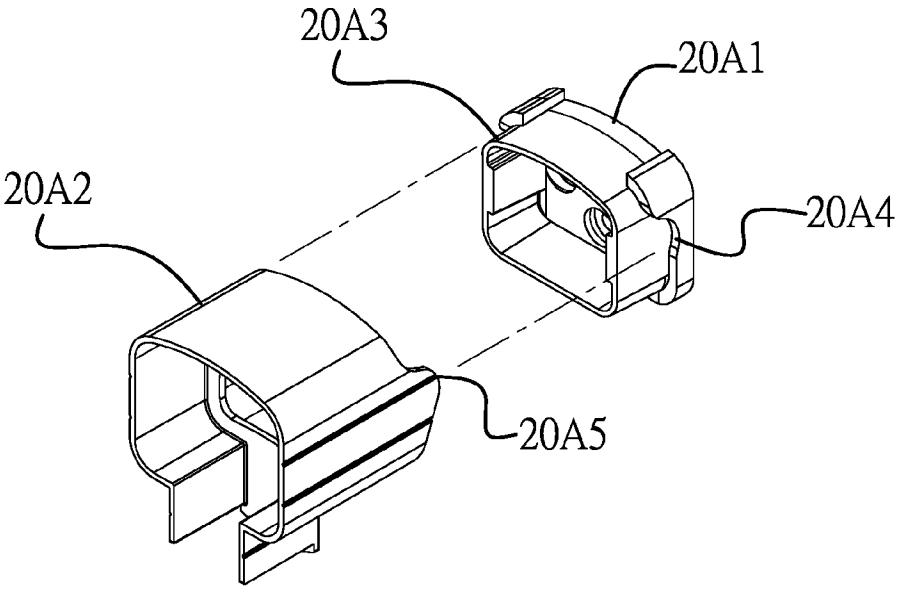
FIG. 11B is an exploded perspective view of a lower pivot element in the present invention.
Figure 11A:
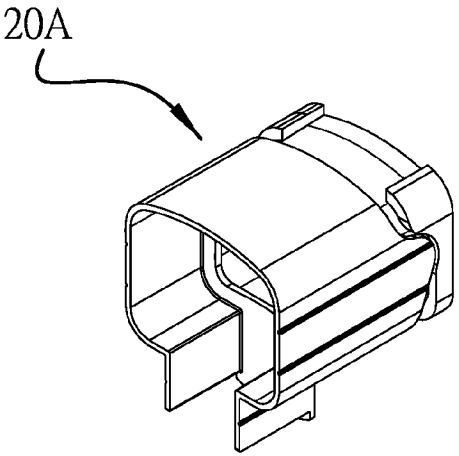
FIG. 11A is an assembly perspective view of a lower pivot element in the present invention.

Please refer to FIG. 8. As shown, after the step plate 200 is supported and fixed by the support bar 50 at the front and rear end, the gap between two sides of the step plate 200 and the lower railing support bar 20 of the railing unit 100 can be covered by a cover plate 95.

Please refer to all of FIGS. 9, 10A, 10B, 11A, and 11B. An upper railing support bar 10 of the railing unit 100 is connected to an upper end of the column 40 through an upper pivot element 10A, and the lower railing support bar 20 is connected to a lower end of the column 40 through a lower pivot element 20A. The upper pivot element 10A and the lower pivot element 20A are provided with fixing portions 10A1, 20A1 and pivot portions 10A2, 20A2 respectively. The inner surfaces of the fixing portions 10A1, 20A1 are provided with through holes for fixing to the column 40. The opposite ends of the fixing portion 10A1, 20A1 are provided with holders 10A3, 20A3. The outer edges of the holders 10A3, 20A3 are formed with arc-shaped recesses 10A4, 20A4.

The pivot portions 10A2, 20A2 are frame-shaped bodies that can be fitted into the holders 10A3, 20A3 of the fixing portions 10A1 and 20A1. The sides of the pivot portions 10A2, 20A2 are formed with a forward projecting convex portion 10A5, 20A5. When the pivot parts 10A2 and 20A2 are attached to the holders 10A3 and 20A3, the convex parts 10A5 and 20A5 are simultaneously brought into contact with the recesses 10A4 and 20A4 of the fixing portions 10A1 and 20A1 so that the pivot portions 10A2 and 20A2 can be slightly rotated up and down on the fixing portions 10A1, 20A1. Thereby the gradient thereof can be adjusted according to on-site environment when two ends of the upper railing support bar 10 and the lower railing support bar 20 penetrate into the interior of the pivot portions 10A2, 20A2, respectively.

Figure 12:
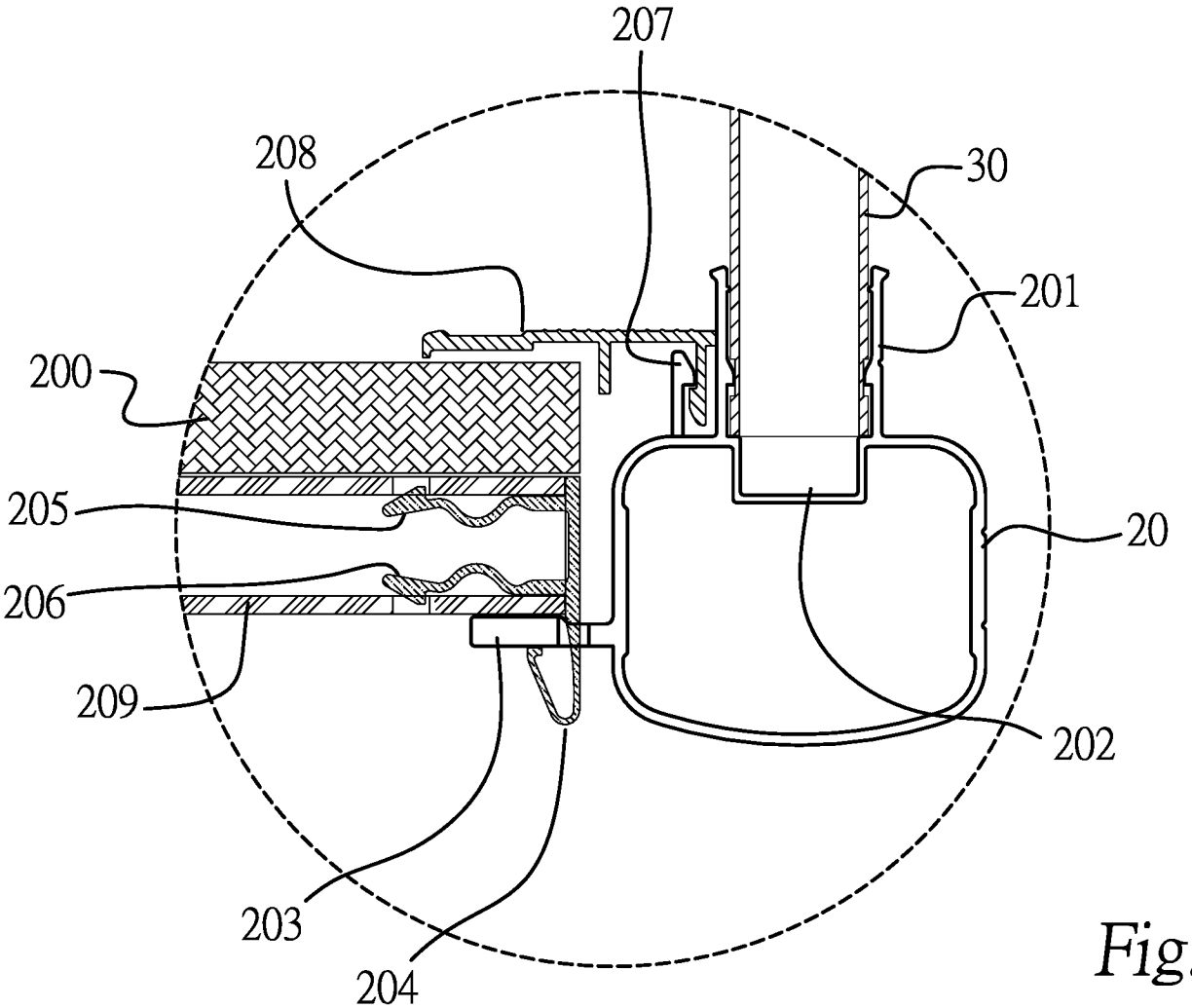
FIG. 12 is a cross-sectional view showing a step plate supported by a lower railing support bar according to the present invention.

Please then refer to FIG. 12. As shown, to provide more stable support for the step plate 200, the lower railing support bar 20 also functions to assist in supporting the step plate 200. As shown, two sets of upwardly extending clips 201 and a groove 202 allowing for insertion of the thin railings 30 are formed on the lower railing support bar 20 at the position corresponding to each of the thin railings 30; a protruding side plate 203 is formed on a side of the lower railing support bar 20 facing the step plate 200; a through hole is provided on the surface of the protruding side plate 203 for insertion of a buckle 204; a horizontally extending upper tongue piece 205 and a horizontally extending lower tongue piece 206 are provided at the upper and lower end of the buckle 204, respectively; additionally, a side piece 207 is formed at the upper end of the lower railing support bar 20 facing the step plate 200; a space is formed between the side piece 207 and the clip 201 for insertion of a locking tab 208; the upper ends of the locking tabs 208 are horizontally extended, whereby the locking plate 208 and the upper tongue piece 205 can hold the step plate 200 up and down; the upper tongue piece 205 and the lower tongue piece 206 can be embedded therein to support the supporting thin tube 209 of the step plate 200.

When the upper railing support bar 10, lower railing support bar 20 and thin railings 30 are all fixed, the spacing between each of the thin railings 30 may be covered by a partition 103, respectively.

The movement range of the upper railing support bar 10 and the lower railing support bar 20 can be set between 5° to 13°. Thus, the gradient of each step plate 200 can be adjusted between 5° and 13° as required and the slope guide plate 300 can also be tilted between 5° and 13° to provide wheelchair facilitation. Moreover, the plurality of step plates 200 can also be assembled in a U-shape (180°), L-shape (90°) and linear type according to on-site requirements.

Accordingly, the accessible passageway assembly of the present invention has the following effects:

1) The accessible passageway assembly in the present invention can be assembled and disassembled quickly and arbitrarily;

2) The accessible passageway assembly in the present invention, is composed of several components; the number of components is small, the structure is simplified, and the gradient and height of the accessible passageway assembly can be adjusted according to the actual demand, thereby wheelchairs can be accessed easily; and 3) The accessible passageway assembly in the present invention adopts high-strength lightweight aluminum alloy forging materials, with good overall carrying capacity and weather resistance, by which outdoor life can reach more than a decade.

As above, the accessible passageway assembly in the present invention certainly has an unprecedented innovative structure, which is not found in any publication. Also, there are no similar products in the market. Therefore, it possesses novelty undoubtedly. In addition, the present invention has unique features and functionality far from the others in the art. It is indeed more inventive than the others in the art, and meets the requirements of the application requirements of the new patent law. Accordingly, the patent application has been filed in accordance with patent law.

It should be noted that the described are preferred embodiments. However, the structural features of the present invention are not limited thereto, and changes and modifications may be made to the described embodiments without departing from the scope of the invention as disposed by the appended claims.

What is claimed is:

1. An accessible passageway assembly, which is formed by a plurality of railing units, a plurality of columns, and a plurality of step plates; wherein the plurality of railing units are disposed at interval by columns to form an inner fence and an outer fence of the passageway; support bars are provided between the columns of the inner fence and the columns of the outer fence, such that step plate are able to be provided between the two support bars; the accessible passageway assembly is characterized in that: the upper end of the support bar is formed with a plurality of convex hooks, and the front and rear side thereof are provided with a lip plate, respectively; a lower end of a platen is provided with a hook by which the platen is hooked with a convex hook of the support bar; the front and rear side thereof are provided with a protruding pressing lip, respectively; wherein when the platen is joined to the upper end of the support bar, said protruding pressing lips and the lip plates of the support bar are able to form an accommodation space, so that the step plate able to be inserted sideways into the accommodating space, whereby the step plate is supported and fixed by the support bar, wherein the gradient between the lip plate of the support bar and the pressing lip of the platen may vary depending on the mount position of the support bar and the platen.

2. The accessible passageway assembly as claimed in claim 1, wherein the connection part of the support bar and the column is provided with a connecting element, the connecting element being provided with a plate to hold the column, an end of the connecting element being provided with a bump for embedding into both ends of the support bar, such that the support bar can be quickly fixed between an inner column and an outer column.

3. The accessible passageway assembly as claimed in claim 1, wherein a pair of upward extending clips are formed on the lower railing support bar at the position corresponding to each of the thin railings, and a protruding side plate is formed on one side thereof facing the step plate; a surface of the protruding side plate is provided with a through hole for insertion of a buckle; the upper and lower end of the buckle are provided with a horizontally extending upper tongue piece and lower tongue piece, respectively; additionally, a side piece is formed at the upper end of the lower railing support bar facing the step plate, whereby a space is formed between the side piece and the clip inside for insertion of a locking tab; the upper end of the locking tab is horizontally extended, whereby the locking plate and the upper tongue piece can hold the step plat up and down; the upper tongue piece and the lower tongue piece can be embedded with a supporting thin tube to support the step plate.

4. The accessible passageway assembly as claimed in claim 1, wherein the movement range of the upper railing support bar and the lower railing support bar can be set between 5° to 13°, the plurality of step plates can be assembled in a U-shape (180°), L-shape (90°), and linear type according to the on-site requirements.

5. The accessible passageway assembly as claimed in claim 1, wherein when the support bar and the platen are mounted on the steps close to a building, a lip plate and a pressing lip at an end thereof allow for insertion of the step plate; a retaining groove is formed on the lip plate at the opposite end thereof, the lip plate and the pressing lip allow for embedding of a wall-against fastener; the wall-against fastener comprising a frame body on which one side being joined to an inverted L-shaped member to be against one side of the support bar; the opposite end of the frame body is formed with a buckle portion whose end is formed with a bump for insertion of the retaining groove of the support bar; the opposite end of the wall-against fastener can be against the building steps through the frame body such that wheelchairs can access the building easily.

6. An accessible passageway assembly, which is formed by a plurality of railing units, a plurality of columns, and a plurality of step plates; wherein the plurality of railing units are disposed at interval by columns to form an inner fence and an outer fence of the passageway; support bars are provided between the columns of the inner fence and the columns of the outer fence, such that step plate are able to be provided between the two support bars; the accessible passageway assembly is characterized in that: the upper end of the support bar is formed with a plurality of convex hooks, and the front and rear side thereof are provided with a lip plate, respectively; a lower end of a platen is provided with a hook by which the platen is hooked with a convex hook of the support bar; the front and rear side thereof are provided with a protruding pressing lip, respectively; wherein when the platen is joined to the upper end of the support bar, said protruding pressing lips and the lip plates of the support bar are able to form an accommodation space, so that the step plate able to be inserted sideways into the accommodating space, whereby the step plate is supported and fixed by the support bar, wherein when the support bar and the platen are disposed at the at the forefront of the passageway, a lip plate at one end and a pressing lip allow for an oblique lead plate fastener to be embedded therein, and the opposite end of lead plate fastener allows for connection to with a guide support bar; specifically, the lead plate fastener includes a frame body on which one side is coupled to an inverted L-shaped member to be against one side of the support bar; an end of the frame body is formed with a buckle portion whose end is formed with a bump for insertion of a retaining groove on the lip plate of the support bar;

additionally, the interior of the frame body is formed with a coupling hole for assembling and fixing the guide support bar through a first thumb lock.

7. The accessible passageway assembly as claimed in claim 6, wherein an end of the guide support bar provides connection to a guide plate member with an end in a pointed shape through a second thumb lock; a slope guide plate is provided between the two guide support bars, such that a wheelchair can enter the passageway through the slope guide plate; the guide plate member can be then fixed to ground through a ground fixture.

8. An accessible passageway assembly, which is formed by a plurality of railing units, a plurality of columns, and a plurality of step plates; wherein the plurality of railing units are disposed at interval by columns to form an inner fence and an outer fence of the passageway; support bars are provided between the columns of the inner fence and the columns of the outer fence, such that step plate are able to be provided between the two support bars; the accessible passageway assembly is characterized in that: the upper end of the support bar is formed with a plurality of convex hooks, and the front and rear side thereof are provided with a lip plate, respectively; a lower end of a platen is provided with a hook by which the platen is hooked with a convex hook of the support bar; the front and rear side thereof are provided with a protruding pressing lip, respectively; wherein when the platen is joined to the upper end of the support bar, said protruding pressing lips and the lip plates of the support bar are able to form an accommodation space, so that the step plate able to be inserted sideways into the accommodating space, whereby the step plate is supported and fixed by the support bar, wherein the railing unit comprises an upper railing support bar, a lower railing support bar and a plurality of thin railings; the upper railing support bar and the lower railing support bar are coupled to the upper end and lower end of the column respectively, the upper end and lower end of the column are locked and connected with a pivot element, respectively; the upper pivot element and the lower pivot element are provided with a fixing portion and a pivot portion, respectively; the inner side of the fixing portion is provided with a through hole to be fixed to the column; the opposite end of the fixing portion is provided with a holder whose outer edge is formed with an arc-shaped recess;

the pivot portion is a frame-shaped body, which can be fitted into the holder of the fixing portion; one side of the pivot portion is formed with a forward projecting convex portion; when the pivot portion is attached to the holder, the convex part is simultaneously brought into contact with the recess of the fixing portion so that the pivot portion can be slightly rotated up and down on the fixing portion; thereby the gradient thereof can be adjusted according to on-site environment when two ends of the upper railing support bar and the lower railing support bar penetrate into the interior of the pivot portions respectively.

* * * * *